US005491873A

United States Patent [19]

Ferguson

[11] Patent Number: 5,491,873

[45] Date of Patent: Feb. 20, 1996

[54] HINGE

[75] Inventor: Adrian G. Ferguson, Auckland, New Zealand

[73] Assignee: Interlock Hardware Developments Limited, Auckland, New Zealand

[21] Appl. No.: 220,920

[22] Filed: Mar. 31, 1994

[30] Foreign Application Priority Data

Mar. 31, 1993 [NZ] New Zealand ..... 247312

[51] Int. Cl.[6] ..... E05D 7/04; E05D 5/02; E05D 11/10

[52] U.S. Cl. ..... 16/245; 16/235; 16/388

[58] Field of Search ..... 16/235, 242, 245, 16/362, 388, 270

[56] References Cited

U.S. PATENT DOCUMENTS

| | | | |
|---|---|---|---|
| 994,196 | 6/1911 | Reddick | 16/245 |
| 2,797,432 | 7/1957 | Gakle | 16/388 |
| 3,977,043 | 8/1976 | Zernig | 16/270 |
| 4,293,976 | 10/1981 | Pittasch et al. | 16/245 |

FOREIGN PATENT DOCUMENTS

| | | | |
|---|---|---|---|
| 21742 | 5/1947 | Finland | 16/387 |
| 2469538 | 5/1981 | France | 16/388 |
| 163132 | 9/1905 | Germany | 16/388 |

*Primary Examiner*—Lowell A. Larson
*Assistant Examiner*—Donald M. Gurley
*Attorney, Agent, or Firm*—Young & Thompson

[57] ABSTRACT

A hinge for mounting a door or like closure within a frame. The hinge comprises a first leaf pivotally coupled to a second leaf. The first leaf has a locating lug which interfits with a recess of the second leaf when the first and second leaves are at a predetermined angular disposition one to the other. This prevents a door mounted by the hinge from being removed from the frame even if the pin which pivotally couples the leaves together is forcibly removed. The first and second leaves are preferably coupled together by a coupling whereby the position of the second leaf relative to the axis of pivotal coupling can be selectively adjusted.

13 Claims, 2 Drawing Sheets

HINGE

BACKGROUND OF THE INVENTION

DISCUSSION OF THE BACKGROUND

This invention relates to a hinge.

More particularly the present invention relates to a hinge for mounting a door or like closure within a door or like frame.

Hinges for doors and the like can present a potential security problem. With some known hinges it is possible to remove the hinge pin, while the door is in the locked and/or closed position. This enables the hinge components to be separated to facilitate removal of the door from the door frame to gain unauthorised entry.

A further problem associated with door hinges is that adjustment of the hinge in order to achieve correct installation and correct hanging of the door is often not possible or can be difficult. For example where the door frame is not plumb the fixed position between the door leaf of the hinge and the frame leaf results in the door not hanging square. Also if the holes drilled in the door frame for fasteners passing through the frame leaf to engage therein are not correctly positioned installation difficulties can arise.

SUMMARY OF THE INVENTION

One object of the present invention is to provide a door hinge whereby separation of the components of the hinge when the hinge is in the "closed" position is not possible even if the hinge pin is removed.

A further object of the present invention is to provide a hinge having a construction which facilitates adjustment of the door leaf of the hinge relative to the frame leaf.

In one broad aspect the present invention provides a hinge comprising a first leaf pivotally coupled to a second leaf, said first leaf having locating means which interfit with receiving means of said second leaf when the first and second leaves are at a predetermined angular disposition one to the other.

According to a second broad aspect of the invention there is provided a hinge comprising a first leaf and a second leaf, a mounting coupled with said second leaf for pivotal movement about a pivot axis, said first leaf being coupled to said mounting by coupling means whereby the position of the first leaf relative to the pivot axis can be selectively adjusted.

DESCRIPTION OF THE INVENTION

DESCRIPTION OF THE PREFERRED EMBODIMENTS

Figure 1:
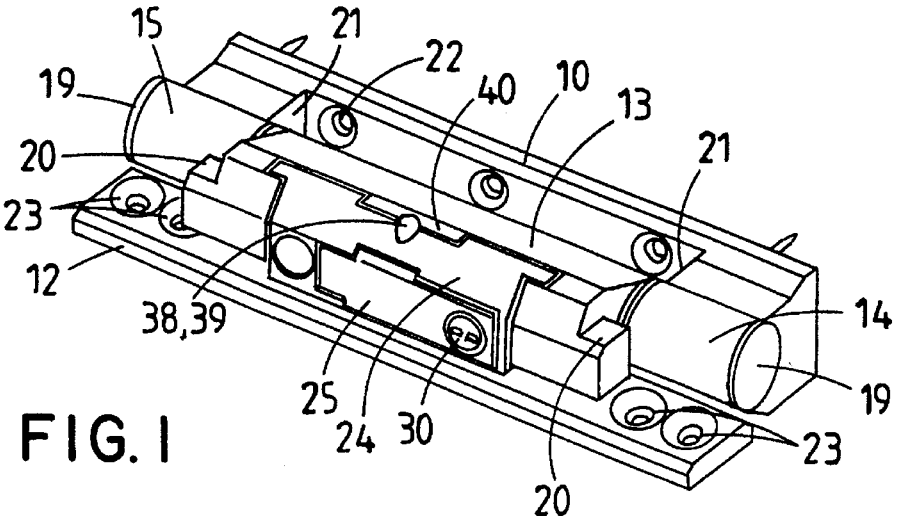
FIG. 1 is a perspective view of the hinge in a fully open position.

The hinge consists of a frame leaf 10, a door leaf 12 and an adjustment block 13. In the assembled state of the hinge adjustment block 13 fits between projections 14 and 15. Into each end of bore 13*a* of adjustment block 13 are inserted flanged bearings 17. Similar flange bearings 18 are located in bores 14*a* and 15*a* of projections 14 and 15. The adjustment block 13 is pivotally coupled to the frame leaf 10 by hinge pin 16 which extends through aligned bearings 17 and 18 and bore 13*a*. As shown the flanges of bearing 17 and 18 are located face to face.

End plugs 19 are located in the outer ends of bores 14*a* and 15*a* once hinge pin 16 has been installed. They cover the ends of pin 16 and result is an aesthetically pleasing appearance.

At each end of adjustment block 13 is a security lug 20 each of which, when the hinge (ie the leaves 10 and 12 are at right angles—see FIGS. 3 and 4), engages within a respective recess 21 in frame leaf 10. Consequently adjustment block 13 and frame leaf 10 interlock. Thus even if the hinge pin 16 is forced out of the hinge when the door D is in the closed and/or locked position the adjustment block 13 cannot be removed from frame leaf 10. This is due to the sliding movement of block 13 necessary to move the lugs 20 from the recesses being prevented by the close proximity of the door frame. Thereby removal of the door from the frame is prevented.

Lugs 20 are so located that they move on an arc (as the hinge opens and closes) the centre of radius of which coincides with the pivot axis of pin 16.

Openings 22 are formed in the base of frame leaf 10. Mechanical fasteners (screws etc.) can pass through openings 22 to facilitate fastening of the frame leaf 10 to the door frame F. Likewise door leaf 12 is provided with openings 23 through which fasteners can pass to mount the door leaf to a door D.

Extending laterally from the plane of door leaf 12 is a flange 24. The door leaf 12 is engaged with the adjustment block 13 by inserting flange 24 into opposed slots 42. This results in a block or projection 40 formed with or attached to adjustment block 13 engaging in a recess or rebate 41 formed in flange 24.

Flange 24 includes a central opening 24*a* into which a cover 25 can fit. When cover 25 is in opening 24*a* tongue 26 of cover 25 engages behind a land 27 formed in the central opening 24*a*. An opposite flange 28 of cover 25 has an opening 29. A plastic or other resilient fastener 30 can be installed in opening 29 to engage in a snap lock arrangement in aperture 31 formed in flange 24.

A cap screw 32 and nut 33 are located and held in place by cover 25 when the cover is positioned in the central opening 24*a* and retained by fastener 30. Head 34 of cap screw 32 engages in a shaped recess 35 in cover 25. A similar recess (not readily apparent in the drawings) is formed in block or projection 40. The body of cap screw 32 locates in curved portion 36 of cover 25. A correspondingly curved portion is also formed in block 40. Nut 33, which is screwed onto the end of cap screw 32, engages in a recess 37 in cover 25. This recess 37 is so shaped that nut 33 cannot rotate therein.

The hinge is assembled by inserting flange 24 into the opposing slots 42 of adjustment block 13. Cap screw 32 with nut 33 threaded thereon is then located in cover 25. Following this cover 25 is placed in position in opening 24*a* and retained therein by fastener 30. The adjustment block 13 can be mounted with frame leaf 10 prior to or following installation of the door leaf 12.

The position of door leaf 12 relative to the adjustment block 13 can be adjusted by manipulating cap screw 32. To facilitate this openings 38 and 39 in flange 24 and block 40 respectively combine to form a passageway through which an allen key or the like can be located to engage with the head 34 of cap screw 32. By turning cap screw 32 clockwise nut 33 is drawn axially toward head 34 resulting in leaf 12 moving away from adjustment block 13. Likewise if cap screw 32 is rotated in an anti clockwise direction nut 33 is moved away from head 34 resulting in leaf 12 moving toward adjustment block 13.

Figure 3:
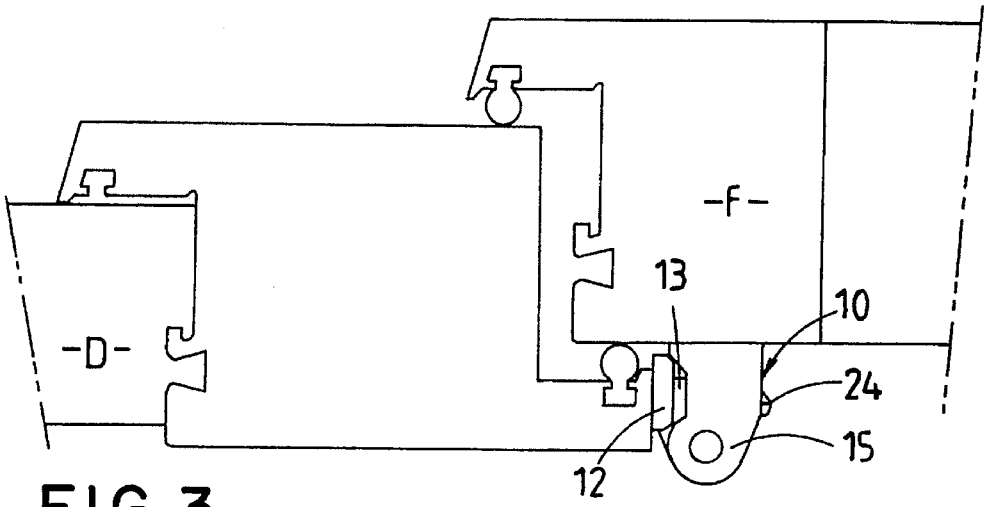
FIG. 3 is an illustration of a door mounted to a door frame by the hinge where the hinge adjustment is fully retracted.
Figure 4:
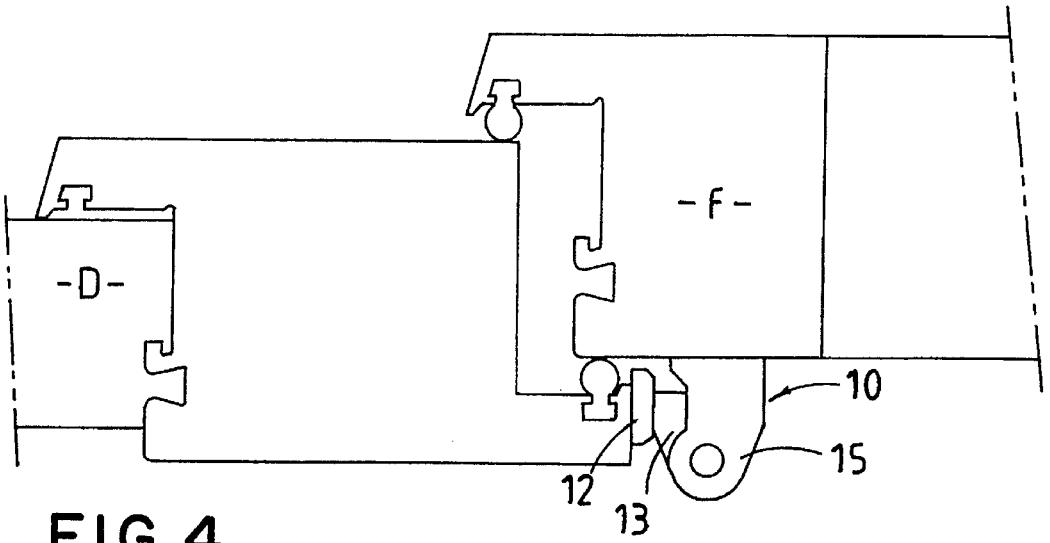
FIG. 4 is a similar view to FIG. 3 but with the hinge adjustment fully extended.

Accordingly when the hinge is fastened to a door manipulation of cap screw 32 can result in adjustments as illustrated by the extremes of adjustment shown in FIGS. 3 and 4.

Figure 2:
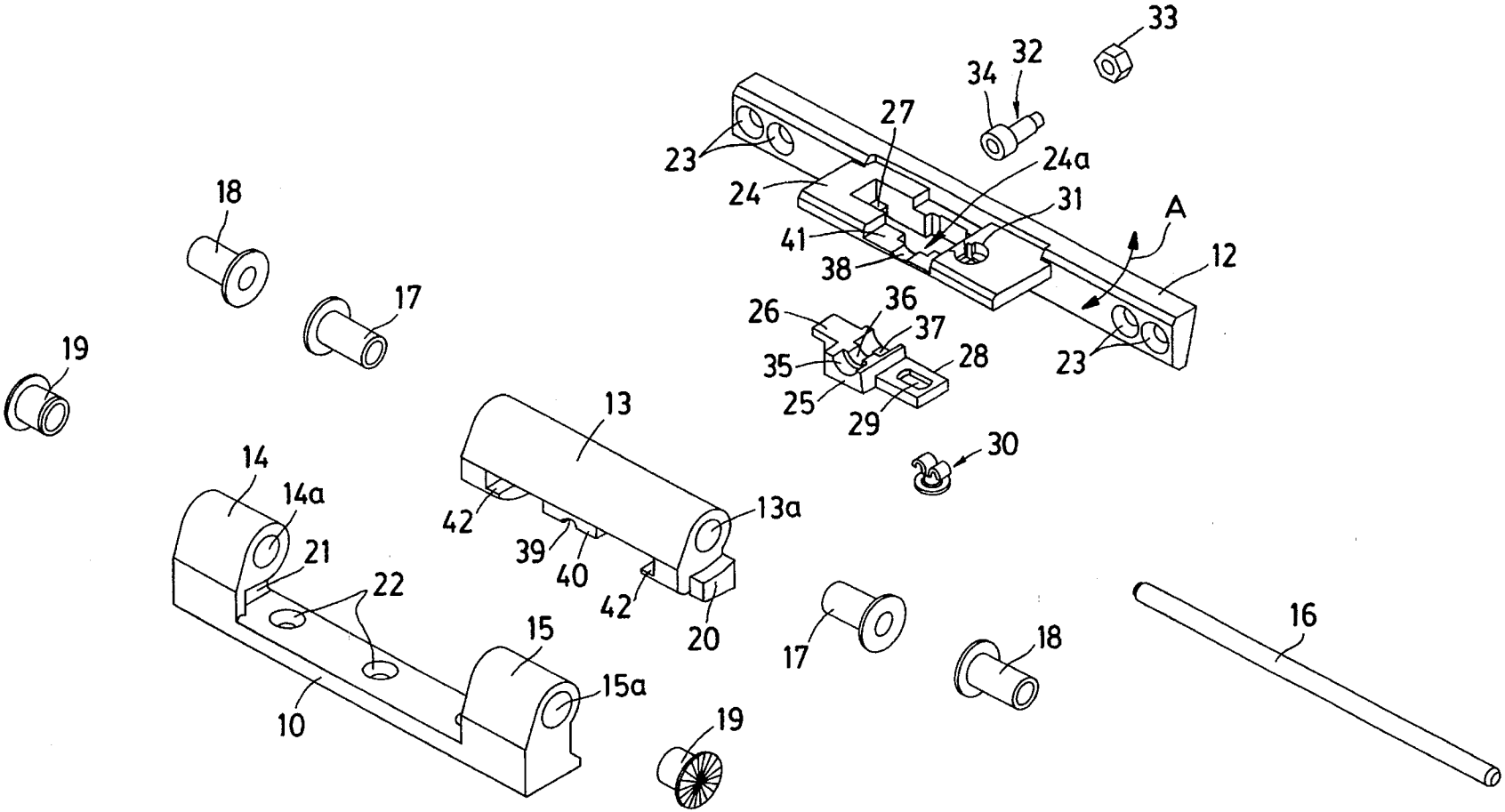
FIG. 2 is an exploded perspective view of the hinge.

The manner by which door leaf 12 is connected to adjustment block 13 is such that a degree of free movement in the direction of arrow A in FIG. 2 results in the hinge being partially self aligning. This free movement can result in a more even distribution of load between hinges on the door and therefore lead to a reduction in the load applied to the hinges as a result of misalignment. Also this partial self aligning can result in installation being easier as the screw holes 22 need not be so critically aligned with openings in the frame as a limited degree of misalignment can be accommodated.

Because the cap screw 32 and nut 33 are inserted after door leaf 12 has been slid into engagement with the adjustment block 13 this insertion effectively "keys" the door leaf and adjustment block together so that they cannot slide apart again. Also as the moving parts ie. flange 24 relative to adjustment block 13 are "T slotted" together extremely desirable strength characteristics are achieved.

Fastener 30 not only retains cover 25 in position but it also tensions the adjustment screw 32 by spring loading the cover against screw 32. This prevents screw 32 from freely unscrewing. Furthermore fastener 30 tensions the door leaf 12 within slots 42 so that there is no free movement between the parts which would cause the hinge to rattle. This also allows for variations in powder-coating thickness and for easy assembly while still achieving a snug fit of the door leaf 12 within the adjustment block 13.

When the hinge is in the position which corresponds with the door being closed there are no exposed screws. As previously described the hinge on a closed door cannot be disassembled even if the pin is removed.

The present invention thus provides an adjustable security hinge which overcomes or goes some way to overcoming traditional problems associated with hinges for doors and like closures.

What is claimed is:

1. A hinge comprising a first leaf pivotally coupled to a second leaf, said first leaf having locating means which interfit with receiving means of said second leaf when the first and second leaves are at a pre-determined angular disposition one to the other, said locating means being two lugs each of which interfits in a respective recess, each said recess being formed in a one of a pair of spaced apart projections carried by the second leaf, there being a pivot pin which passes through aligned openings in the projections and an opening in a part of the first leaf which is located between the projections, said first leaf part having said lugs.

2. A hinge as claimed in claim 1 wherein the lugs are located to be moveable on an arc having a centre of radius coinciding with the axis of pivotal coupling of the first and second leaves.

3. A hinge as claimed in claim 2 wherein the first and second leaves are located at right angles to one another when said lugs are located within said recesses.

4. A hinge as claimed in claim 1 wherein the first and second leaves are coupled together via an adjustment block.

5. A hinge as claimed in claim 1 wherein the first and second leaves are coupled together via an adjustment block, said first leaf having a flange which slidingly interfits with said adjustment block, said pivot pin passing through said adjustment block and there being adjustment means whereby the pivot axis of the pivot pin can be moved relative to the first leaf.

6. A hinge as claimed in claim 5 wherein the adjustment means comprises a threaded member engaged between first and second locating means associated respectively with said adjustment block in said flange, said threaded member being engaged in a threaded opening fixedly located with said first leaf such that rotation of the threaded member in said threaded opening applies a force to the first leaf to move the first leaf relative to the adjusting block.

7. A hinge as claimed in claim 6 wherein the second locating means applies a force to the threaded member to prevent the threaded member from freely rotating.

8. A hinge comprising a first leaf and a second leaf, a mounting coupled to said second leaf for movement about a pivot axis by a pivot pin passing through the mounting, the first leaf having a flange which slidingly interfits with said mounting, and adjustment means comprising a threaded member engaged between first and second locating means associated respectively with said mounting and said flange, said threaded member being engaged in a threaded opening fixedly located with said first leaf such that rotation of the threaded member in said threaded opening applies a force to the first leaf to move the first leaf relative to the mounting.

9. A hinge as claimed in claim 8 wherein the second locating means applies a force to the threaded member to prevent the threaded member from freely rotating.

10. A hinge as claimed in claims 8 further including locating means which interfit with receiving means of said second leaf when the first and second leaves are at a predetermined angular disposition one to the other.

11. A hinge as claimed in claim 10 wherein the locating means is formed by a pair of spaced apart lugs and the receiving means is formed by a pair of spaced apart recesses, said lugs and recesses being formed such that a said lug fits into a corresponding recess when the first and second leaves are located at right angles to one another.

12. A hinge as claimed in claim 11 wherein a said recess is formed in each of a pair of spaced apart projections carried by the second leaf, the pivot pin being located through aligned openings in the projections and an opening in said mounting which is located between the projections.

13. A hinge as claimed in claim 12 wherein the lugs are located to be moveable on an arc having a centre of radius coinciding with the pivot axis of the pivot pin.

* * * * *